United States Patent [19]

Dearnaley et al.

[11] 4,394,180

[45] Jul. 19, 1983

[54] METHOD OF FORMING HIGH RESISTIVITY REGIONS IN GAAS BY DEUTERON IMPLANTATION

[75] Inventors: Geoffrey Dearnaley, Abingdon, England; Kenneth Steeples, Edinburgh, Scotland; Ian J. Saunders, Morecambe, England

[73] Assignee: United Kingdom Atomic Energy Authority, London, England

[21] Appl. No.: 158,871

[22] Filed: Jun. 12, 1980

[30] Foreign Application Priority Data

Jun. 12, 1979 [GB] United Kingdom ..... 7920389

[51] Int. Cl.[3] ..... H01L 21/263

[52] U.S. Cl. ..... 148/1.5; 29/576 B; 148/187; 357/61; 357/91

[58] Field of Search ..... 148/1.5, 187; 29/571, 29/576B; 357/61, 91

[56] References Cited

U.S. PATENT DOCUMENTS 3,961,989 6/1976 Heslop ..... 148/1.5

4,290,825 9/1981 Dearnaley et al. ..... 148/33.4

OTHER PUBLICATIONS

Ohmura et al., Phys. Stat. Solid. 15a (1973) 93.

Sattler et al., Phys. Rev. 161 (1967) 244.

Newman et al., Radiation Effects, 53 (1980) 41.

*Primary Examiner*—Upendra Roy

*Attorney, Agent, or Firm*—Larson and Taylor

[57] ABSTRACT

A process for producing regions of high resistivity in gallium arsenide, and other related compounds and mixed crystals which show electrical behavior which is similar to that of gallium arsenide, in which deuterons are implanted into a substrate made of the semi-conductor body with energies up to a maximum value corresponding to a desired depth of penetration into the body. Apparatus for carrying out the process also is described.

9 Claims, 3 Drawing Figures

METHOD OF FORMING HIGH RESISTIVITY REGIONS IN GAAS BY DEUTERON IMPLANTATION

Figure 1:
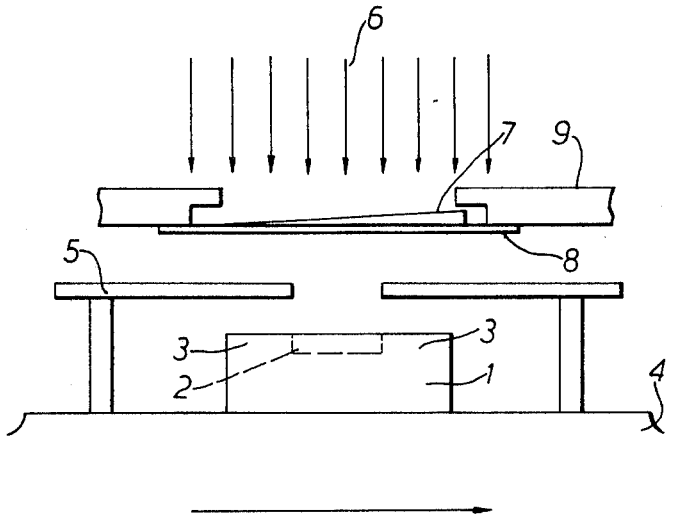

The present invention relates in particular to semiconductor devices made from gallium arsenide, and other related compounds and mixed crystals which show similar electrical behaviour to gallium arsenide.

Gallium arsenide and the related materials mentioned above are becoming increasingly important as semi-conductor materials, particularly for use in devices which operate at frequencies equivalent to the microwave region of the electromagnetic spectrum, and in optical devices such as light-emitting diodes, lasers and photodiodes.

In order to produce such devices, it may be necessary to provide regions of high resistivity within a substrate having a generally lower resistivity. One way of doing this is to bombard appropriate regions of a body of gallium arsenide with protons through a mask which is formed on the surface of the body of gallium arsenide by techniques which are well known in the semi-conductor art. Although devices produced in this way are useful, due to the relatively high mobility of protons in gallium arsenide, the maximum continuous operating temperature of proton implanted gallium arsenide device is about 300° C. At operating temperatures approaching this value, defect sites in the gallium arsenide lattice, with which the protons are associated, are annealed out, with a consequent loss of the carrier traps provided by the proton-defect complexes, and the conductivity rises. Eventually the device fails.

In our co-pending application No. 7904342 filed on the Feb. 7th, 1979, there is described a process for producing regions of high resistivity in a semi-conductor substrate body of material of the type described, comprising the operations of implanting protons into the said regions of the substrate with energies up to a maximum value corresponding to a desired depth of penetration of the protons into the substrate, and implanting deuterons into the said regions of the substrate with energies such as to give the same depth of penetration as for the protons.

There is also disclosed a form of semi-conductor device fabricated from a body of semi-conductor material which has been processed according to the invention.

The high resistivity areas produced by the above process have excellent high temperature stability, and so the devices are suitable for use in arduous conditions. The process, however, is lengthy and so the resultant devices are costly, which could prevent them being used in domestic electronic equipment where price is a major consideration and very high temperature stability is not required.

According to the present invention there is provided a process for producing regions of high resistivity in a semiconductor substrate body of the type described, comprising the operation of implanting deuterons alone into the substrate body with energies up to a maximum value corresponding to a desired depth of penetration into the substrate body.

The increase in resistivity is related to the amount of deuterons implanted into the substrate body. A suitable range of doses is between $10^{12}$ and $10^{16}$ deuterons per $cm^2$; a preferred dose at a single energy is of some $10^{13}$ to $10^{14}$ deuterons per $cm^2$. Preferably, to achieve a high resistivity region some 10 $\mu$m deep a total dose of up to about $10^{15}/cm^2$ is implanted with energies which range from 0.1 to 1.0 MeV.

Although the high restivity material produced by the process of the present invention may not have quite the same high temperature stability as that produced by the process which forms the subject of our earlier application, it is perfectly adequate for less arduous conditions of use, and the process is cheaper to operate than the earlier process, thus leading to the production of cheaper devices. In particular, as deuteron doses some two orders of magnitude less than the corresponding proton doses may be employed in most cases, very substantial increases in processing rate can be achieved.

Figure 2:
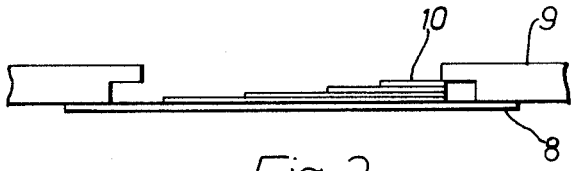
Figure 3:
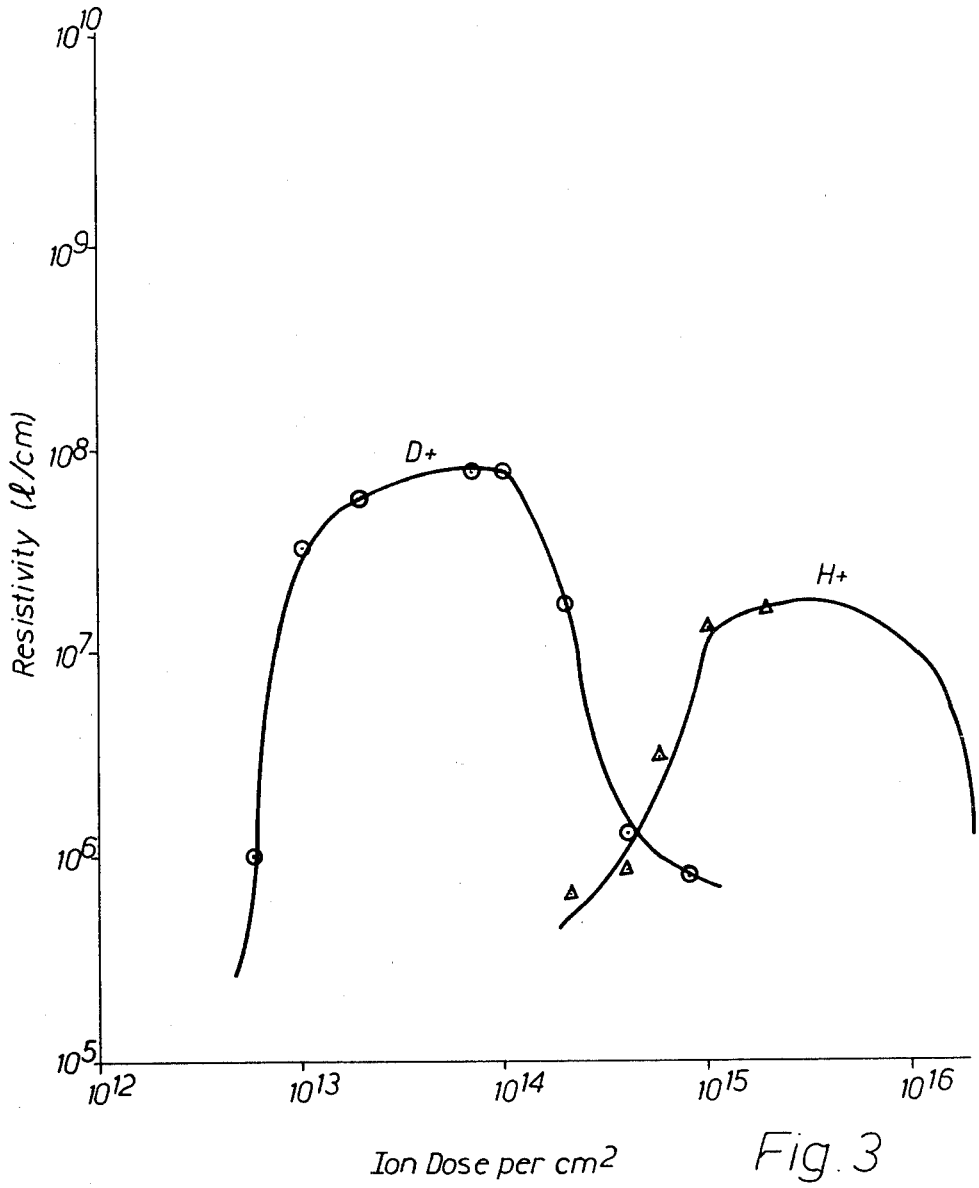

The invention will now be described, by way of example, with reference to the accompanying drawings in which, FIG. 1 is a diagrammatic representation of an apparatus in which the invention can be carried out, FIG. 2 shows an alternative form of a component of the embodiment of FIG. 1, and FIG. 3 is a graph showing the resistivity of deuteron-implanted gallium arsenide compared with that of proton-implanted gallium arsenide.

Referring to FIG. 1 of the drawings, there is shown a body 1 of gallium arsenide in which a region 2 of high resistivity is to be formed between two regions 3 of low resistivity as part of the process of production of a semiconductor device. The body 1 is mounted on a work table 4 which is arranged to be moved by a mechanism which is not shown so that it can be traversed at various rates. Fixed to the table above the body 1 is a shadow mask 5 arranged to expose the region 2 to the action of a beam of deuterons 6 which are produced from a molecular source which is not illustrated. The shadow mask 5 is sufficiently thick to be able to stop the most energetic deuterons in the beam 6. An alternative masking system which is not illustrated would be the deposition of masking material over the surface of the body 1 with the exception of the area 2. Above the moving table 4 there is positioned a stationary wedge 7 supported on a thin substrate 8 and attached to a screen 9 which permits the beam 6 to pass only through the wedge 7 to reach the body 1. The thickness of the wedge 7 is varied so that deuterons passing through the wedge and substrate 8 from the beam 6 of energy some 2.0 MeV, would emerge with energies which range from 1.0 MeV at the thinner end to 0.1 MeV at the thicker end. Thus as the body 1 passes under the beam it will be subjected to implantation of deuterons at a continuously decreasing energy and by this means and be controlling the rate of movement of the table 4 the desired dose of deuterons is implanted at energies varying from 0.1 to 1.0 MeV, so that a uniform high resistivity region 2 is produced of the desired thickness, that is, about 10 $\mu$m.

The deuteron beam 6 has a beam current up to 0.2 $\mu A/cm^2$, which is limited by the need to avoid undue heating of the body 1, which might cause the radiation-induced defects arising from the bombardment, and which are thought to be a major cause of the effects of the process of the present invention, to be annealed out. Ion doses of $10^{15}/cm^2$ can be implanted in some 15 minutes, and a dose of $10^{13}/cm^2$ in less than 10 seconds. Thus for a body 1 of gallium arsenide doped at about $10^{18}/cm^3$, a high resistivity region 2 some 10 $\mu$m deep can be produced in about 15 minutes. Once the implantation of the body 1 has been completed, it is removed from the apparatus and processed in the normal way to provide a semi-conductor device.

In some cases a single energy of deuteron beam will suffice for the device application, and here the wedge 7 and the traversing of table 4 can be omitted; it would be possible in suitable cases to process the body 1 using only a few seconds of exposure to the deuteron beam. Several single energy values could be employed if necessary.

In an alternative apparatus, which is not illustrated, the body 1 is kept stationary and a wedge similar to the wedge 7 is moved across the beam to produce the effects described above.

FIG. 2 shows an alternative way in which variation in the energy of the implanted deuterons can be achieved. The wedge 7 is replaced by an assembly 10 of foils of equal thickness which in effect provides a stepped wedge. This stepped wedge is employed in exactly the same way as the continuously varying wedge 7 previously described.

All these arrangements of apparatus can be used in the processing of semi-conductors other than gallium arsenide and related materials, and with beams other than deuterons, to produce beams of more than a single energy without adjustment of accelerating potentials.

The final resistivity of the implanted material is found to be dependent upon both the dopant in the starting material and its concentration. A variation in the resistivity of the implanted material of over an order of magnitude can occur, as shown in the table below, which shows the initial and final resistivities of a number of different samples of gallium arsenide. Even the lowest value of the final resistivity shown is some eight orders of magnitude higher than that of the starting material. This is perfectly adequate for the production of most devices. The table also gives the temperature at which breakdown occurs. It can be seen that this too is adequate for most purposes.

FIG. 3 shows the variation of the resistivity of gallium arsenide with the ion dose for both protons and deuterons. It can be seen that deuterons give a maximum resistivity which is some eight times higher than that of proton-implanted gallium arsenide at a dose which is two orders of magnitude less.

We claim:

1. A process for producing a semi-conductor device having regions of high resistivity in a semi-conductor substrate body comprising gallium arsenide or other related compounds and mixed crystals which show similar electrical behavior to gallium arsenide, comprising the sole operation of implanting deuterons only into the said regions of the substrate body with energies only up to a maximum value corresponding to a desired depth of penetration into the substrate body.

2. A method according to claim 1 wherein the substrate is gallium arsenide.

3. A method according to claim 1 wherein the deuterons are implanted in the form of a beam, the beam current of which is 0.2 $\mu$A per cm$^2$.

4. A method according to claim 1 wherein the areas adjacent said regions are masked.

5. A method according to claim 2 wherein the number of deuterons implanted in the substrate is in the range $10^{12}$ to $10^{16}$ per cm$^2$.

6. A method according to claim 2 wherein the gallium arsenide is doped initially so as to have a resistivity of the order of $10^{-2}\Omega$cm.

7. A method according to claim 3 wherein a total deuteron dose of $10^{15}$ per cm$^2$ is implanted with energies in the range 0.1 to 1.0 MeV.

8. A method according to claim 3 wherein the deuteron dose is between $10^{13}$ and $10^{14}$ per cm$^2$ and the deuterons are implanted with a single energy.

9. A method according to claim 4 wherein the deuteron energies vary continuously from 0.1 to 1.0 MeV.

* * * * *

| Material | GaAs | GaAs | GaAs | GaAs | GaAs | GaAs | GaAs |
|---|---|---|---|---|---|---|---|
| Dopant | Te | Ge | Te/Co | Sn | Se | S | Si |
| Dopant Density (per cm$^2$) | $10^{18}$ | $2 \times 10^{17}$ | $10^{18}$ | $6 \times 10^{6}$ | $5 \times 10^{18}$ | $5 \times 10^{16}$ | $2 \times 10^{18}$ |
| Initial Resistivity ($\Omega$cm) | $10^{-2}$ | $10^{-2}$ | $10^{-2}$ | $10^{-2}$ | $10^{-2}$ | $10^{-1}$ | $10^{-2}$ |
| D+ density (per cm$^2$) | $10^{13}$ | $10^{13}$ | $10^{13}$ | $10^{13}$ | $10^{13}$ | $10^{13}$ | $10^{13}$ |
| Final Resistivity (M$\Omega$cm) | 1.6 | 16.0 | 23.0 | 75.0 | 3.0 | 86.0 | 80.0 |
| Annealing Temp. failure (°C.) | 400 | 600 | 500 | 600 | 400 | 600 | 450 |